US006000575A

United States Patent [19]

LaCour et al.

[11] Patent Number: 6,000,575

[45] Date of Patent: Dec. 14, 1999

[54] MOVABLE BEVERAGE CONTAINER HOLDER

[76] Inventors: Rachel C LaCour; Jim M LaCour, both of 4404 Tideview La., Jacksonville, Fla. 32250; Scott J McCarthy; Michele L McCarthy, both of 50 Loggerhead Ct., Ponce Inlet, Fla. 32127

[21] Appl. No.: 08/889,426

[22] Filed: Jul. 8, 1997

[51] Int. Cl.[6] ..... B65D 25/24

[52] U.S. Cl. ..... 220/739; 248/311.2

[58] Field of Search ..... 248/311.2, 205.5, 248/205.7, 362, 363; 224/926, 555, 559; 220/903, 737, 739, 483, 480, 476

[56] References Cited

U.S. PATENT DOCUMENTS

| | | | |
|---|---|---|---|
| 698,496 | 4/1902 | Hill | 206/519 |
| 1,000,858 | 8/1911 | Ulrich | 248/205.7 |
| 2,839,260 | 6/1958 | Jacobi, Jr. | 248/362 |
| 3,093,356 | 6/1963 | Buyalos, Jr. | 248/362 |
| 5,613,659 | 3/1997 | Hong | 248/205.7 |
| 5,667,180 | 9/1997 | Duckworth | 248/311.2 |

FOREIGN PATENT DOCUMENTS

| | | | |
|---|---|---|---|
| 2605914 | 8/1977 | Germany | 248/362 |

*Primary Examiner*—Stephen J. Castellano

[57] ABSTRACT

A hard plastic or nylon beverage insulator holder (2) mated with a suction cup (1) inserted into the accepting ring (5) of the beverage insulator holder (2) specifically designed to firmly secure the unit to a smooth surface. The beverage insulator holder (2) is dimensioned to receive a standard sized beverage insulator and a beverage container, such as a can or a bottle. The beverage insulator holder (2) is also equiped with cup handle notch outs (6) on opposing sides to receive coffee cup handles and also finger slots for ease of receiving and removing the beverage insulator. The false bottom (3) ensures a flat and stable surface for the beverage insulator. The four stablizing feet (4) ensure the stability of the unit. The beverage insulator holder (2) is designed to accept beverage insulators, beverage containers with handles, and beverage containers.

1 Claim, 3 Drawing Sheets

FRONT VIEW

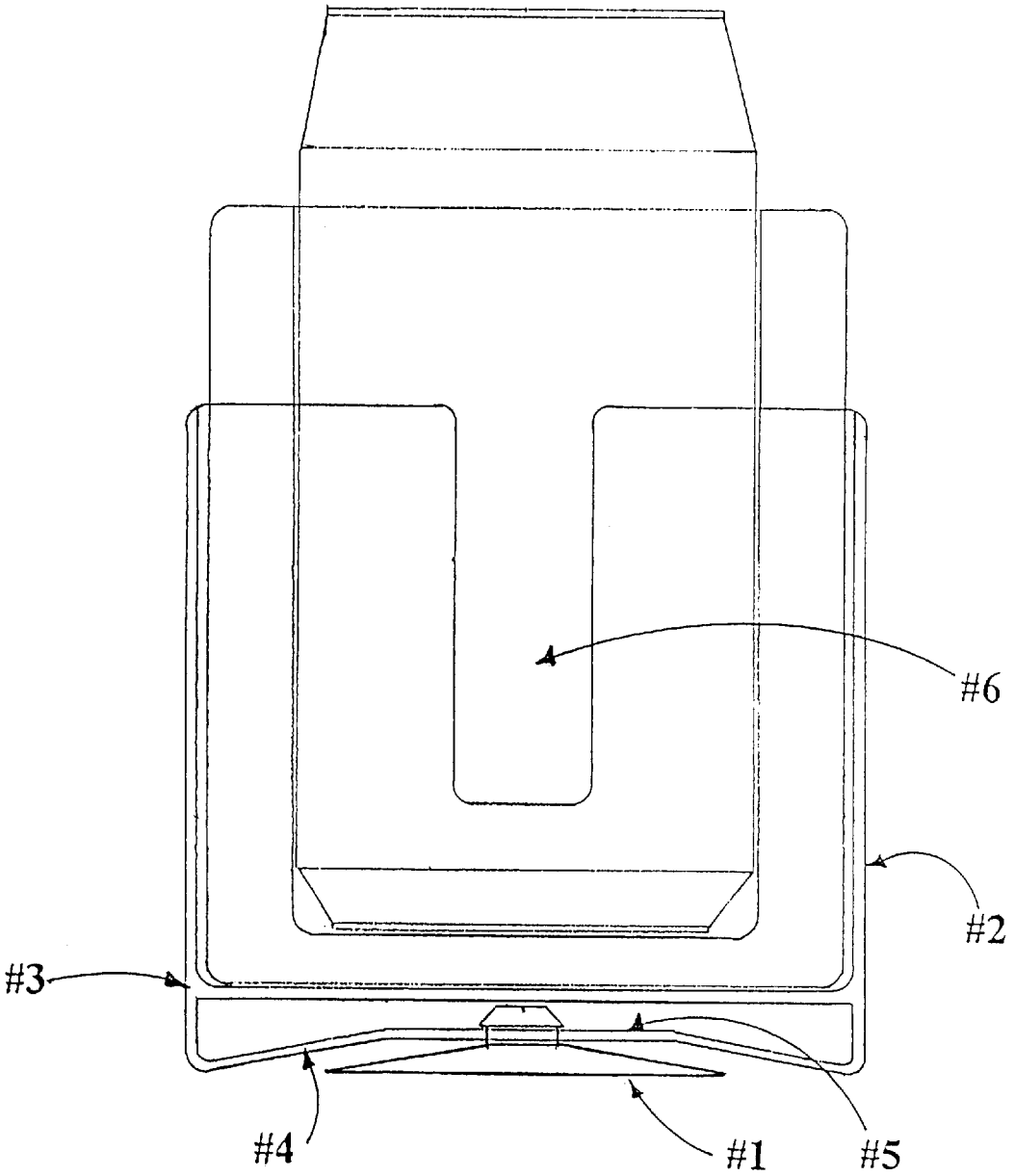
FRONT VIEW
FIGURE #1

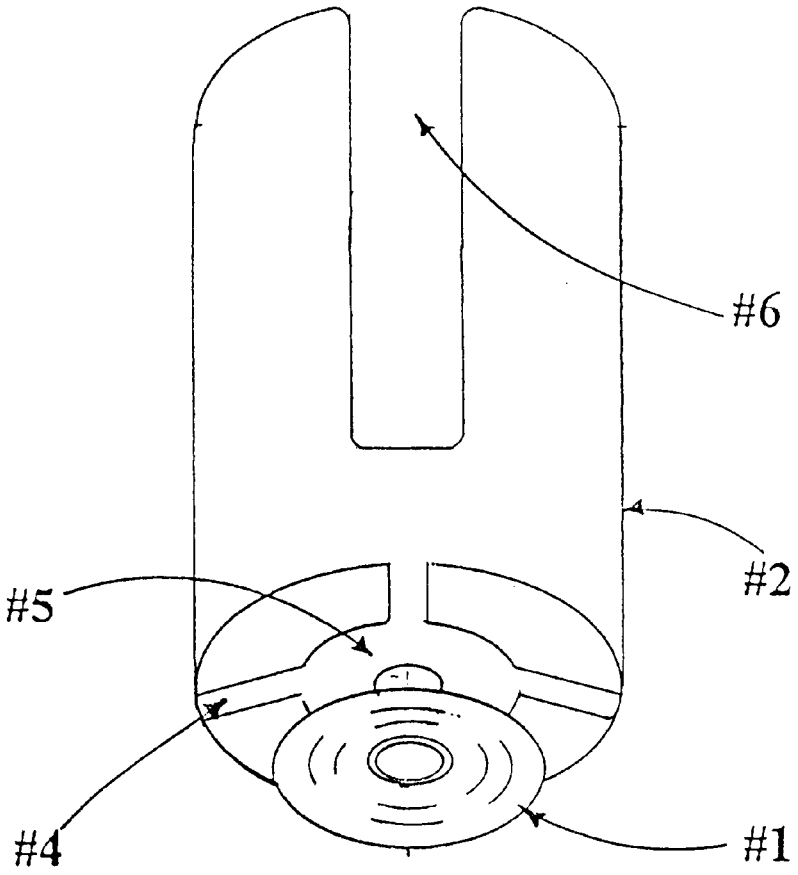
ISOMETRIC FROM BOTTOM
FIGURE #2

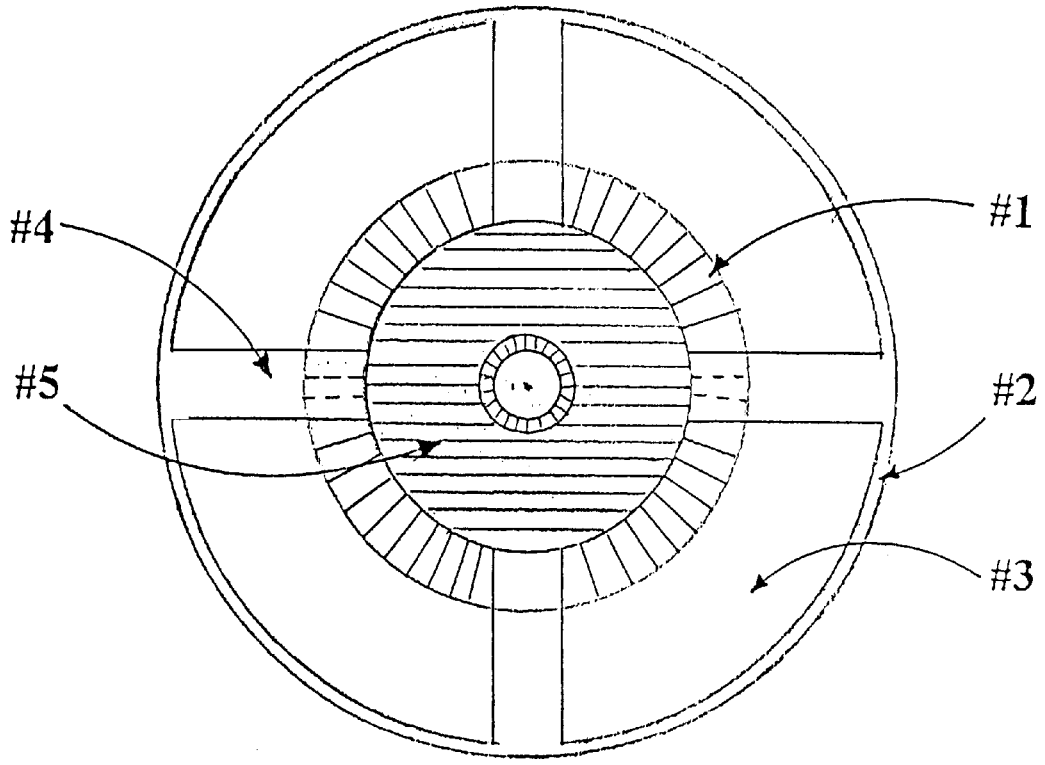
DOWN VIEW
FIGURE #3

MOVABLE BEVERAGE CONTAINER HOLDER

CROSS REFERENCES TO RELATED APPLICATIONS

1. Field of Invention

This invention relates to beverage container holders capable of receiving various beverage containers, and more specifically the ability to hold fast to a smooth surface by a suction cup device, thus allowing the beverage container holder to be easily moved.

2. Description of Prior Art

In many applications there is a need to temporarily hold a beverage container of some type. A major requirement of this is for the holder to be mobile and able to be easily fastened to many surfaces, and to accept different types and sizes of beverage containers.

Heretofore many different beverage holders were used so they could be mounted to a surface. The following is a discussion of these arrangements and their drawbacks.

One type involved an insulated beverage container holder secured to an intended mounting surface by cooperating hook and loop type fasteners. McBride, U.S. Pat. No. 5,186,350, 1993, is exemplary. However in these arrangements the hook and loop fasteners are permanently adhered to a horizontal surface, thus limiting the mounting location of the beverage container holder to said location.

Another arrangement, shown in Washburn U.S. Pat. No. D226,126, 1973, comprised a base for holding bottles or the like, however it does not provide a vehicle for securing to a surface and is limited to one size and type of container.

In still another type shown in Wintz, U.S. Pat. No. D236,175, 1973, while the gimbled receptacle for drink holders allows for a variety of types and sizes of containers, the holder requires permanent mounting (by way of screws) to a vertical surface, thus limiting the mounting location of the beverage container holder to said location.

Koger, U.S. Pat. No. 2,754,078, 1951, shows a foldable bottle holder that permanently mounts to a vertical surface (by way of screws). The downfall of this is two fold, it is limited to bottles, and is limited to the permanent mounting location.

The suction cup can holder is constructed of rubber with a large suction cup that securely mounts the holder to a horizontal surface. The downfall is that the holder is limited to cans and bottles.

OBJECTS AND ADVANTAGES

Accordingly, several objects and advantages of the invention will hold a drink insulator and a drink fastened to any smooth surface by way of suction. Prior art is not readily movable.

Still further objects and advantages will become apparent from a consideration of the ensuing description and accompanying drawings.

BRIEF DESCRIPTION OF THE DRAWINGS

FIG. 1 is a Front view showing the suction cup in place, the one piece molded plastic holder, a typical beverage insulator, and a beverage can.

FIG. 2 is an Isometric drawing from the bottom prior to the mating of the suction cup and plastic holder.

FIG. 3 is a Down view showing the suction cup, and the four feet of the plastic holder.

REFERENCE NUMERALS

1 suction cup
2 beverage container holder
3 false bottom
4 stablizing feet
5 accepting ring
6 handle notch outs

SUMMARY

A movable beverage container holder comprising: a hollow cyclindrical body, attaching to any smooth surface by way of a securement vehicle in which air is compressed to form a vacuum, said securement vehicle to mate with the accepting ring intergrally molded to the bottom of said body for mounting purpose, stabilized by feet designed to mate with the surface when the said securment vehicle is compressed, the beverage container is supported by an end plate integrally molded as a component to the bottom end face of said body, said body is able to accomodate a beverage container, an insulated beverage container or a beverage container with handle by way of void in side wall in said body.

PREFERRED EMBODIMENT—DESCRIPTION

FIG. 1. Shows a Front View of the beverage container holder 2 with handle notch outs 6 for cup handles and overall ease of cup removal. The holder made out of hard plastic or nylon, has four stablizing feet 4 which stablize the unit, it is also made with a false bottom 3 to ensure a flat and stable surface for the container. The suction cup 1 will hold fast to any smooth surface making the holder both secure and movable. The beverage holder insulator (a) and beverage can (b) fit snugly into the holder for which it is most specifically designed.

FIG. 2. Shows an isometric drawing from the bottom, prior to the mating of the suction cup 1 and the beverage container holder 2. Clearly shown is the cup handle notch 8 which is on either side of the holder. The stablizing feet 4 are attached to the accepting ring 5 that receives the suction cup 1.

FIG. 3. Shows a down view of the beverage container holder 2, with the suction cup 1 locked in place into the accepting ring 5.

PREFERRED EMBODIMENT—OPERATION

The operation and function of the invention is simple and straightforward. When the insulator holder 2 is pressed down onto a smooth surface the suction cup 1 forces the air out and holds fast to the surface. The stablizing feet 4 are designed to mate with the surface when the suction cup 1 is at full compression adding stability to the unit. The false bottom 3 is located directly over the mating button of the suction cup 1, allowing ample room for the assembly of the accepting ring 5 and the suction cup 1. The function of the cup handle notch outs 8 is two fold. The first function is for coffee cup handles, and the like, to be inserted into the notches. The second function is for ease of insertion and removal of insulators and cups.

CONCLUSIONS, RAMIFICATIONS, AND SCOPE

Accordingly, it is seen that, according to the invention, a suction cup device mated with an insulator holder will firmly and securely hold a beverage insulator, a beverage container with handle or a beverage container. As stated the holder can be made from hard plastic or nylon. The assembly is simplistic with only the mating of the suction cup and holder, which will ensure an economical, reliable, and easy to fabricate device.

Although the description above contains many specificities, these should not be construed as limiting the scope of the invention but as merely providing illustrations of some of the presently preferred embodiments of this invention. Various other embodiments and ramifications are possible within it's scope. For example, beverage insulators may be designed to mate directly with suction devices, and since there are numerous types of beverage insulators this may be a large spinoff.

Thus the scope of the invention should be determined by the appended claims and their legal equivalents, rather than by the examples given.

What is claimed is:

1. A portable holder for beverage containers, the holder comprising;

a hollow cylindrical sidewall and a bottom wall forming an enclosure for supporting a beverage container therein, the sidewall having a pair of diametrically opposed notches formed in an upper edge of the sidewall for receiving the handle of a beverage container when the beverage container is placed within the enclosure; and a stabilizing structure including an accepting ring and a series of stabilizing feet which are integrally molded in one piece with the sidewall and bottom wall and extend underneath the bottom wall, each stabilizing foot is formed from an upright portion extending vertically downwardly from the bottom edge of the sidewall and an accepting ring connecting portion which extends from the bottom edge of the upright portion inwardly and upwardly to the accepting ring, the accepting ring is oriented horizontally beneath the bottom wall of the enclosure so that the accepting ring is centered with respect to the longitudinal axis of the cylindrical sidewall, each stabilizing foot is integrally connected to the accepting ring, a suction cup is attached to the accepting ring so that the stabilizing structure can be detachably connected to a flat supporting surface, the stabilizing feet contact the supporting surface when the suction cup is fully depressed for further stabilization of the enclosure and the beverage container placed therein.

* * * * *